United States Patent [19]

Moreman, III

[11] Patent Number: 5,067,876

[45] Date of Patent: Nov. 26, 1991

[54] GAS TURBINE BLADED DISK

[75] Inventor: Otis S. Moreman, III, Cincinnati, Ohio

[73] Assignee: General Electric Company, Cincinnati, Ohio

[21] Appl. No.: 500,974

[22] Filed: Mar. 29, 1990

[51] Int. Cl.[5] ..... F01D 5/30

[52] U.S. Cl. ..... 416/219 R; 416/248

[58] Field of Search ..... 416/193 A, 204 A, 219 R, 416/220 R, 223 A, 248

[56] References Cited

U.S. PATENT DOCUMENTS

| | | | |
|---|---|---|---|
| 1,793,468 | 2/1931 | Densmore | 416/219 R |
| 2,415,847 | 2/1947 | Redding | 230/132 |
| 2,619,318 | 11/1952 | Schaer | 253/65 |
| 3,112,914 | 12/1963 | Wellman | 253/77 |
| 3,628,890 | 12/1971 | Sayre et al. | 416/220 R |
| 3,871,791 | 3/1975 | Guy et al. | 416/193 |
| 3,986,793 | 10/1976 | Warner et al. | 416/212 A |
| 4,169,694 | 10/1979 | Sanday | 416/219 R |
| 4,363,602 | 12/1982 | Martin | 416/230 R |
| 4,460,315 | 7/1984 | Tseng et al. | 416/219 R |
| 4,595,340 | 6/1986 | Klassen et al. | 416/193 A |
| 4,621,979 | 11/1986 | Zipps et al. | 416/219 R |
| 4,767,274 | 8/1988 | Walter | 416/193 A |

FOREIGN PATENT DOCUMENTS

| | | | |
|---|---|---|---|
| 108805 | 6/1984 | Japan | 416/219 R |
| 798613 | 7/1958 | United Kingdom | 416/219 R |

*Primary Examiner*—Edward K. Look
*Assistant Examiner*—James A. Larson
*Attorney, Agent, or Firm*—Jerome C. Squillaro

[57] ABSTRACT

A new and improved rotor blade and bladed disk assembly are disclosed. In the preferred embodiment, the blade includes a curved and twisted dovetail disposed generally parallel to a sloping outer perimeter of a rotor disk which allows the dovetail to accommodate centrifugal loading of the blade through complementary dovetail slots for obtaining improved low cycle fatigue and high cycle fatique life limits and a relatively stiff blade for maintaining 2/REV margin. In an exemplary embodiment, the dovetail comprises a section of a helix and the dovetail is self retaining in the dovetail slot against axial components of centrifugal loading.

40 Claims, 3 Drawing Sheets

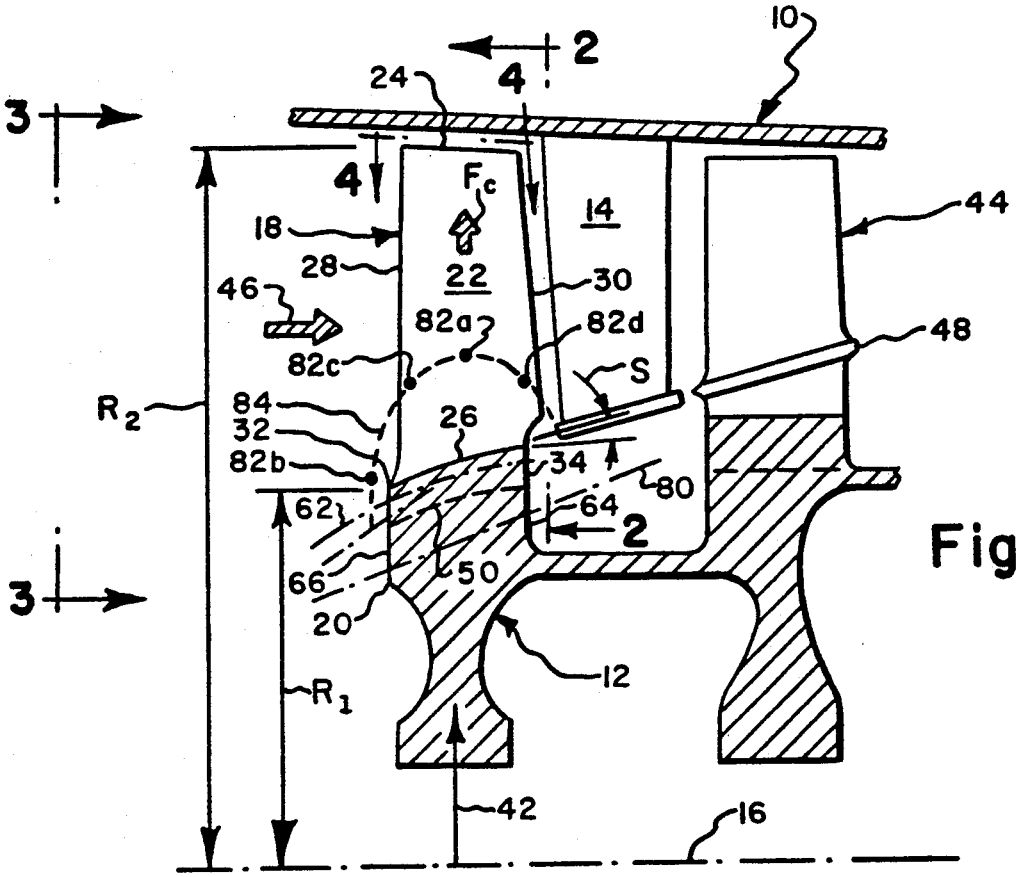
Fig. 1.
Fig. 2.
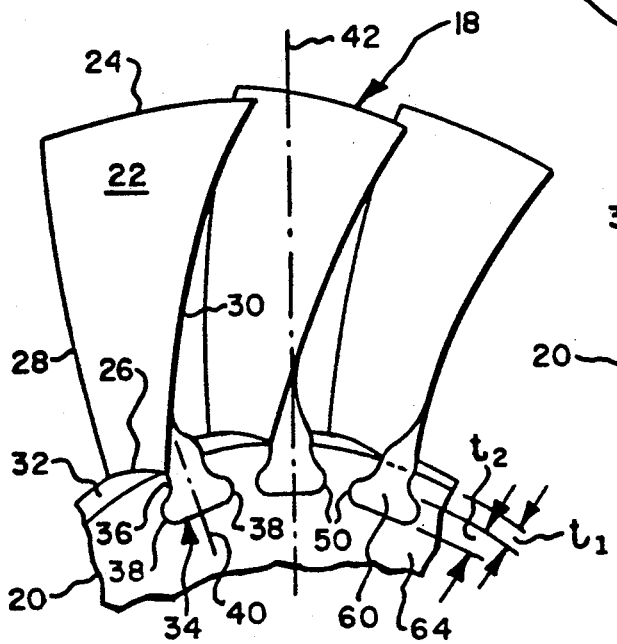
Fig. 3.
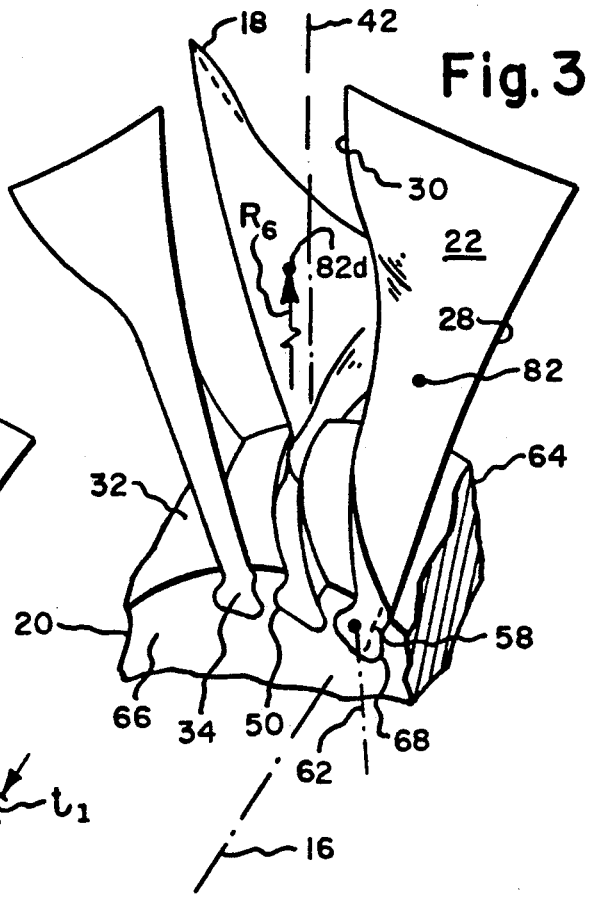

GAS TURBINE BLADED DISK

TECHNICAL FIELD

The present invention relates generally to gas turbine engine rotor blades, and, more specifically, to blades and bladed disk assemblies of fan and compressor sections thereof.

BACKGROUND ART

Bladed disk assemblies, i.e., discrete blades having dovetails mounted in complementary shaped slots in a rotor disk, are well known in the art. Disk assemblies having integral blades and disks i.e., bl(ade)+integral (d)isk="blisk", are also well known in the art; see, for example, U.S. Pat. No. 4,363,602 to J. R. Martin, entitled "Composite Air Foil and Disk Assembly," and U.S. Pat. No. 4,595,340 to D. D. Klassen et al. entitled "Gas Turbine Bladed Disk Assembly".

The use of a blisk assembly over a bladed disk assembly provides many benefits including increased structural strength and improved aerodynamic performance. In particular, a blisk can be designed for obtaining relatively low radius ratio defined as the inlet root radius divided by the blade tip radius, having values less than about 0.5, and relatively high blade root solidity, defined as the root chord length divided by the distance between adjacent blades, having values greater than about 2.3 for obtaining significant improvements in aerodynamic performance. Blisks also typically include relatively high root slope angles of greater than about 10° since the blisk stage is effective for efficiently compressing airflow in a relatively short axial distance.

Although blisks provide substantial aerodynamic performance benefits, it is deemed desirable to have replaceable blades for more easily repairing any foreign object damage thereto. However, experience has shown that conventional bladed disk assemblies are limited to radius ratios greater than about 0.35–0.5 and solidity less than about 2.2 due to life and strength considerations including low cycle fatigue (LCF) and high cycle fatigue (HCF). It should be appreciated that for any given compressor stage, the number and size of the blades needed for performing the required amount of work is generally a fixed requirement. With this given number of blades, it will be appreciated that for obtaining reduced radius ratios to improve aerodynamic performance, the outer perimeter of the disk must be correspondingly reduced, thusly providing less circumferential space for mounting the blades thereto and thereby increasing solidity.

Accordingly, smaller shank and dovetail portions of the blade are required due to the physical limitations of the decreased circumference for low radius ratio applications. However, inasmuch as the size of the airfoil portion of the blade does not basically change, the required smaller conventional dovetail and shank are structurally inadequate for suitably mounting the blade to the disk. For example, such a conventional shank and dovetail would be relatively more flexible and have less load transfer surface area thus leading to undesirable LCF and HCF life in the dovetail and disk assemblies. In particular, the increased flexibility of a conventional low radius ratio blade would decrease the 2/REV margin in a gas turbine engine. The 2/REV excitation frequency is typical and in order to have acceptable HCF life of the blade, a relatively stiff bladed disk assembly having adequate 2/REV margin is desirable.

Inasmuch as a gas turbine rotor typically operates at substantial rotational speeds, centrifugal force generated by the mass of the rotating blades is substantial. The means for securing the blades to the rotor disk therefore must be able to accommodate the substantial centrifugal forces while obtaining acceptable LCF life and acceptably low axial components of such centrifugal force which would tend to slide the blade axially outward from the disk.

OBJECTS OF THE INVENTION

Accordingly, it is an object of the present invention to provide a new and improved bladed disk assembly.

Another object of the present invention is to provide a new and improved rotor blade for a bladed disk assembly.

Another object of the present invention is to provide a bladed disk assembly which is interchangeable with a blisk assembly having a relatively low radius ratio, relatively high solidity, and relatively high root slope.

Another object of the present invention is to provide an improved rotor blade having an improved dovetail.

Another object of the present invention is to provide an improved rotor blade having a dovetail which is relatively lighter than conventional dovetails while maintaining acceptable bending stiffness and load carrying ability.

Another object of the present invention is to provide an improved rotor blade for a low radius ratio application which has no or relatively little axial component of centrifugal force generated in a dovetail thereof.

DISCLOSURE OF INVENTION

The invention comprises a new and improved rotor blade and a bladed disk assembly including such rotor blade. The blade includes a dovetail extending from an airfoil, and the dovetail includes a longitudinal axis and forward and aft profiles disposed perpendicularly thereto. The forward and aft profiles are rotated relative to each other to allow the dovetail to be installed in a rotor disk in a low radius ratio application.

BRIEF DESCRIPTION OF DRAWINGS

The novel features believed characteristic of the invention are set forth and differentiated in the claims. The invention, in accordance with a preferred, exemplary embodiment, together with further objects and advantages thereof, is more particularly described in the following detailed description taken in conjunction with the accompanying drawing in which:

FIG. 1 is a partly sectional view of a compressor of a gas turbine engine according to one embodiment of the present invention.

FIG. 2 is an aft end view of a bladed rotor in accordance with the preferred embodiment of the invention taken along line 2—2 in FIG. 1.

FIG. 3 is a perspective, partially sectional view of a portion of a bladed disk in accordance with the preferred embodiment of the present invention taken along line 3—3 in FIG. 1.

MODE(S) FOR CARRYING OUT THE INVENTION

Figure 4:
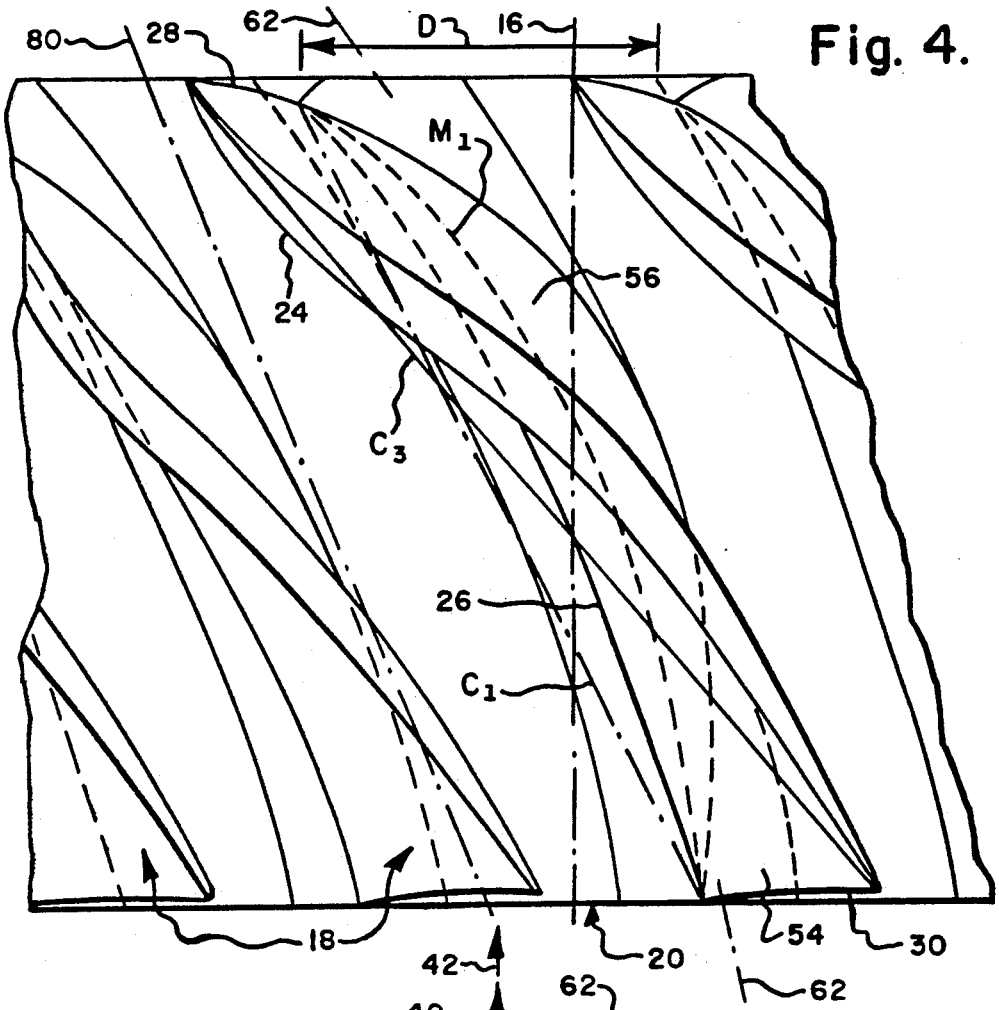
FIG. 4 is a top view of a bladed disk in accordance with the preferred embodiment of the invention taken along line 4—4 in FIG. 1.

Illustrated in FIG. 1 is a portion of a compressor 10 of a gas turbine engine. The compressor 10 includes a first, inlet stage bladed disk assembly 12 in accordance with a preferred, exemplary embodiment of the present invention which is disposed upstream of and coaxially with a plurality of circumferentially spaced conventional stator vanes 14 about an axial centerline axis 16. The bladed disk assembly 12 includes a plurality of circumferentially spaced rotor blades 18 attached to a rotor disk 20 in accordance with the present invention.

More specifically, the blades 18 each include a relatively thin, solid airfoil 22 having a radially outer tip 24, a radially inner root 26, and a leading edge 28 and a trailing edge 30 extending between the tip 24 and root 26. Blades typically include generally rectangular platforms at roots thereof for defining an inner flowpath boundary. In the preferred embodiment of the preferred invention, the blade 18 does not utilize such a platform, although in some embodiments a conventional platform may be utilized. However, instead of using a platform, the present invention utilizes in a preferred embodiment, an outer perimeter 32 of the rotor disk 20 as the radially inner flowpath of the bladed disk 12. The outer perimeter 32 is relatively highly sloped, at an angle S relative to the centerline axis 16 in the range of about 20 to about 35 degrees, upwardly toward the blade tip 24, from the leading edge 28 to the trailing edge 30 for providing the inner airflow boundary in the compressor 10.

The blade 18 further includes a dovetail 34 in accordance with a preferred, exemplary embodiment of the present invention which extends radially inwardly from the airfoil root 26. As illustrated in FIG. 2, the dovetail 34 is symmetrical and includes a shank 36 extending radially inwardly from the airfoil root 26 and a pair of lobes 38 extending radially inwardly from the shank 36 and oppositely outwardly from a dovetail radial axis 40, which in the embodiment illustrated is a vertical centerline axis of the dovetail 40. The dovetail radial axis 40 may or may not be disposed parallel to a radial axis 42 of the rotor disk 20.

Also illustrated in FIG. 1 is a conventional second stage bladed disk assembly 44 disposed downstream from the bladed disk 12 and conventionally connected to the rotor disk thereof. Air 46 is channeled into the compressor 10 and flows through the bladed disk 12, vanes 14, and the second stage 44 and is compressed therethrough. The second stage 44 includes conventional generally rectangular platforms 48 at the radially inner ends of the blades thereof for providing an inner boundary for the air 46 channeled through the second stage 44. As best illustrated in FIGS. 2 and 3, the disk 20 includes a plurality of generally axially extending circumferentially spaced dovetail slots 50 in the outer perimeter 32 which are complementary in shape to the blade dovetails 34, and which receive the dovetails 34 for attaching the blades 18 to the disk 20.

Referring again to FIG. 1, the blades 18 have a relatively low inlet root radius ratio $R_1/R_2$, defined with respect to the centerline 16 extending through the center of the rotor disk 20, which is equal to the root radius $R_1$ of the blade 18 defined at the leading edge 28 divided by the tip radius $R_2$ of the blade tip 24 at the leading edge 28.

As illustrated in FIG. 4, which is a top view of the blades 18 illustrated in FIG. 1, the blades 18 are circumferentially spaced from each other a distance D between adjacent leading edges 28 at the root 26, which is shown partly in phantom in FIG. 4. Each blade 18 has a chord of length $C_1$ extending from the leading edge 28 to the trailing edge 30 at the root 26, and a meanline $M_1$ which also extends therebetween but instead of being a straight line, meanline $M_1$ represents a line equidistantly spaced between a concave surface 54 and a convex surface 56 of the blades 18 which extend between the leading edge 28 to the trailing edge 30 from the root 26 to the tip 24. Blade root solidity is defined as the ratio $C_1/D$ and is a nondimensional indication of, and is directly proportional to, the centrifugal loads which must be suitably accommodated by the disk slots 50. Relatively large values of solidity indicate that the disk slots 50 will receive relatively large centrifugal loads from the blades 18 through the dovetails 34. Experience has shown that for maintaining sufficient LCF and HCF life limits in the dovetail 34, including the shank 36 and the lobe pairs 38, and slots 50, the use of conventional bladed disk assemblies is limited to solidity values up to about 2.2.

Figure 5:
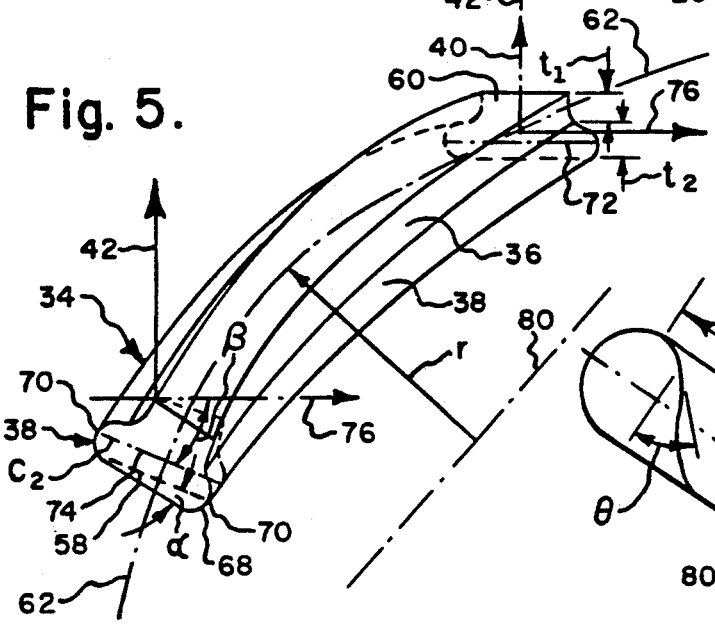
FIG. 5 is a perspective view of a dovetail for a blade in a bladed disk in accordance with a preferred embodiment of the present invention.

The bladed disk assembly 12 according to one embodiment of the present invention includes new and improved features which allow for reduced inlet radius ratios and increased solidity as compared to conventional bladed disk assemblies for obtaining improved aerodynamic performance while providing acceptable life and stress levels of the assembly. More specifically, a significant feature of the present invention includes the dovetail 34 as shown for example with reference to FIGS. 3 and 5. FIG. 3 illustrates two blades 18 mounted in an installed position in the rotor disk 20 and a third, middle, rotor blade 18 partially inserted into the rotor disk 20 which shows the dovetail slot 50 more clearly. FIG. 5 illustrates only the dovetail 34 with the airfoil 22 removed for clarity.

The dovetail 34 includes a planar forward profile 58 (shown partly in phantom in FIG. 5) disposed adjacent to the airfoil leading edge 28 (as illustrated in FIG. 3) and a planar aft profile 60 which is generally similar to the forward profile 58 and in the preferred embodiment is identical thereto, which is disposed adjacent to the airfoil trailing edge 30 (as illustrated in FIG. 2). The dovetail 34 further includes a longitudinal centerline axis 62 which extends from the forward profile 58 to the aft profile 60 and perpendicularly thereto. The forward and aft profiles 58 and 60 and all profiles therebetween are described as being the outer surface of the dovetail 34 each defined at a single plane which is perpendicular to the longitudinal axis 62 and are identical, symmetrical profiles in the preferred embodiment.

In the preferred embodiment of the invention illustrated in FIGS. 2 and 5, the aft profile 60 is coplanar with an annular aft surface 64 of the rotor disk 20. Since the longitudinal axis 62 of the dovetail 34 is arcuate, as further described hereinbelow, the forward profile 58 represents the last complete profile of the dovetail 34 perpendicular to the longitudinal axis 62 at an annular forward surface 66 of the rotor disk 20 as illustrated in FIG. 3. The disk aft surface 64 and forward surface 66 are parallel to each other and perpendicular to the disk axial axis 16 with the outer perimeter 32 of the disk 20 joining the aft and forward surfaces 64 and 66. Since the dovetail longitudinal axis 62 is arcuate and in the embodiment illustrated in FIG. 3 is disposed obliquely to the disk axial axis 16, the forward profile 58 of the dovetail 34 will not be coplanar with the disk forward surface 66. Since the disk forward surface 66 is not disposed perpendiculary to the dovetail longitudinal axis 62, a forwardmost end profile 68 of the dovetail 34 represents an oblique planar profile of the dovetail 34 relative to the dovetail longitudinal axis 62, which as illustrated in FIGS. 3 and 5 represents a distorted, non-symmetrical profile compared to the forward, symmetrical profile 58. The forwardmost end profile 68 intersects the forward profile 58 at an angle $\alpha$ of about 45 degrees in this exemplary embodiment.

Referring again to FIG. 5, the dovetail lobe pairs 38 each further includes a peak 70 and the lobe pair 38 includes a chord extending between the lobe peaks 70. The chord in the dovetail aft profile 60 is an aft chord 72 of length $C_2$ and the chord in the dovetail forward profile 58 is a forward chord 74 of length $C_2$. As illustrated in FIG. 5, the dovetail longitudinal axis 62 is arcuate and the dovetail 34 is twisted relative to the dovetail longitudinal axis 62. One manner of describing the twist of the dovetail 34 may be represented by the angular orientation of the forward profile 58 relative to the aft profile 60. In other words, the forward chord 74 through the lobe pairs 38 is disposed at an angular position rotated relative to the angular position of the aft chord 72. Using the aft profile 60 as a reference, including the dovetail radial axis 40 at the aft profile 60, a transverse axis 76 may be defined perpendicularly to the radial axis 40 and coplanar therewith. The aft chord 72 is disposed generally parallel to the transverse axis 76 in the aft profile 60 and perpendicularly to the radial axis 40 in the aft profile 60. In contrast, the forward chord 74 relative to the transverse axis 76 and aft chord 72 of the aft profile 60 is disposed at an angle $\beta$ of about 60 degrees in the forward profile 58. All dovetail profiles disposed perpendicularly to the longitudinal axis 62 are identical and symmetrical relative to respective radial axii 40 thereof. However, all such profiles, except the aft profile 60, are non-symmetrical relative to the rotor radial axis 42 since they are twisted relative thereto.

The significance of the twisted and arcuate dovetail 34 is more fully appreciated by examining FIGS. 2 and 3. The dovetail aft profile 60 is adjacent to and coplanar with the disk aft surface 64, and the forward profile 58 is adjacent to the disk forward surface 66 and contacts the disk forward surface 66 along a portion of the forward profile 58, the left-hand portion as illustrated in FIG. 3, with the forward end profile 68 being coplanar with the disk forward surface 66. Comparing FIGS. 2 and 3, adjacent ones of the dovetail forward profile 58 of adjacent blades 18 are disposed closer to each other than adjacent ones of the dovetail aft profiles 60 are disposed to each other. Furthermore, the dovetail aft profile 60 is disposed radially closer to the airfoil 22 than the dovetail forward profile 58 is, due to the twist of the profiles around the dovetail longitudinal axis 62.

Since the rotor disk 20 (as illustrated in FIG. 1) has a relatively high slope S and a relatively low inlet root radius ratio $R_1/R_2$, the outer perimeter 32 of the disk 20 is smaller at the disk forward surface 66 than it is at the disk aft surface 64. Accordingly, a relatively smaller circumference is provided for accommodating a dovetail in the disk 20. By twisting and curving the dovetail 34 as illustrated, for example, in FIG. 5, the dovetail 34 can be made to fit in the outer perimeter 32 at the aft surface 64 of the disk as well as at the relatively smaller outer perimeter 32 at the forward surface 66 of the disk 20. The transverse profiles of the dovetail 34 disposed perpendicularly to the dovetail longitudinal axis 62 may continuously rotate about the arcuate longitudinal axis 62 from the aft surface 64 to the forward surface 66 in order to be oriented at the forward surface 66 of the disk 20 to allow for acceptable load transfer between the dovetail 34 and the disk 20 at the forward surface 66. If the dovetail 34 did not twist as illustrated in FIG. 5, it is readily seen that the complementary dovetail slots 50 as illustrated in FIG. 3 would either intersect each other at the forward surface 66 or be so close to each other to provide for unacceptable transfer of loads from the blades 68 through the dovetail 34 to the disk 20 since insufficient material would be provided at the forward surface 66 and axially inwardly thereof toward the aft surface 64.

Referring to FIGS. 1, 3 and 5, the dovetail 34 is shown as being disposed relatively close to the disk outer perimeter 32 therefore resulting in a generally "shankless" dovetail 34. More specifically, since the outer perimeter 32 of the disk 20 is sloped radially outwardly at the angle S from the forward surface 66 to the aft surface 64 for providing a sloped inner flowpath surface for the air 46 to accommodate the increasing radius ratio of the disk 20 from the forward surface 66 to the aft surface 64, the dovetail 34 may be positioned just below the surface of the outer perimeter 32 and generally parallel thereto. The dovetail longitudinal axis 62, therefore, will be generally parallel to the disk outer perimeter 32 as illustrated in FIG. 1 and have a slope generally equal to the slope S relative to the disk centerline axis 16. For the range of angle S relative to the disk centerline axis 16 specifically disclosed above, i.e., about 20 to about 35 degrees, the dovetail longitudinal axis 62 has a slope of greater than about 20 degrees. Alternatively, the dovetail longitudinal axis 62 has a slope represented by $90° - S$ (e.g. 55°–70°), which is less than about 70 degrees, relative to the dovetail radial axis 40 in a plane extending between the forward and aft profiles 58 and 60 as shown in FIG. 1. This arrangement reduces the overall weight of the dovetail 34 for reducing the amount of centrifugal loads which must be accommodated by the dovetail 34.

Referring to FIGS. 2 and 5, the dovetail shank 36 has a thickness in the radial direction $t_1$ and the dovetail lobe pair 38 has a thickness in the radial direction $t_2$. The dovetail 34 is considered substantially shankless since the shank thickness $t_1$ is generally no greater than about the thickness $t_2$ of the lobe pair 38. Of course, the thicknesses $t_1$ and $t_2$ may vary in other embodiments. However, the dovetail 34 is nevertheless considered shankless since the radial thickness of the shank 36 is generally no greater than the radial thickness of the dovetail lobe pair 38 so that the dovetail 34 may be located as close as possible to the outer perimeter 32 of the rotor disk 20 from the forward surface 66 to the aft surface 64 while still providing acceptable load transfer from the dovetail 34 into the disk 20.

Figure 6:
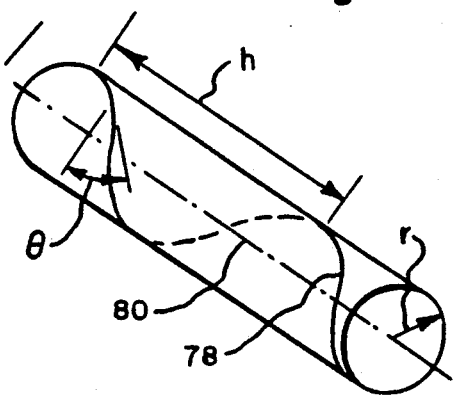
FIG. 6 is a schematic representation of a helix.

In accordance with a preferred embodiment of the present invention, the dovetail 34 as represented by the longitudinal axis 62 comprises a section of a helix. More specifically, illustrated in FIG. 6 is a helix 78 which is the curve of a screw thread on a cylinder of radius r from a helix centerline axis 80. The helix 78 crosses the cylinder at a constant angle $\theta$. The helix 78 has a pitch h which is the length of one coil of the helix relative to the centerline axis 80. The dovetail 34 in accordance with a preferred embodiment of the present invention, comprises a section of the helix 78 as illustrated in FIG. 5 wherein the dovetail longitudinal axis 62 comprises the section of the helix 78 disposed at a radius r from the helix centerline axis 80. Such a helical dovetail centerline axis 62 is preferred in order to reduce or eliminate axial components of the centrifugal force of the rotating blades 18 which would tend to slide conventional dovetails axially out of the disk 20.

More specifically, and referring to FIG. 1, $F_c$ represents the radially outwardly directed centrifugal force acting on the blades 18 when they are rotated with the disk 20 during operation. Since the dovetail 34, including the dovetail longitudinal axis 62 is disposed generally parallel to the outer perimeter 32 of the rotor disk 20, and therefore at the slope angle S, an axial component of the centrifugal force $F_c$ will act upon the dovetail 34 which will tend to slide the dovetail 34 out of the slot 50. The axial component of centrifugal force $F_c$ may be represented by $F_c \sin S$, which is a substantial amount for slope angles greater than about 10°. In the particular embodiment illustrated, the slope angle S is about 30° and the axial component of centrifugal force is about $F_c/2$. If a conventional dovetail were utilized in the disk 20, the axial component of centrifugal force $F_c/2$ would be so substantial that either the blade 18 could not be designed for retention in the disk 20, or substantial conventional blade retainers would be required thus adding to the complexity and weight of the rotor assembly. In accordance with a preferred embodiment of the present invention, the helical longitudinal axis 62 of the dovetail 34 may be configured and oriented to reduce or eliminate the axial component of centrifugal force due to the slope S which would tend to push the dovetail 34 from the retention slot 50.

More specifically, the helical longitudinal axis 62 of the dovetail 34 may be configured and oriented so that the helical axis 80 which defines the helical longitudinal axis 62 at a radius r is not coincident with the disk axial centerline axis 16. If the helical axis 80 were coincident with the disk axial centerline axis 16, the dovetail longitudinal axis 62 would simply be disposed generally diagonally across the outer perimeter 32 of the disk 20 and any axial forces acting on the blade 18 would be unresisted by the dovetail 34, thus requiring conventional axial blade retainers.

However, the radius r of the dovetail longitudinal axis 62 and the orientation of the helical axis 80 may be selected for placing the dovetail 34 as close as possible to and generally parallel to the outer perimeter 32 of the disk 20 and for reducing or eliminating the axial component of centrifugal load $F_c$ acting on the dovetail 34.

Figure 7:
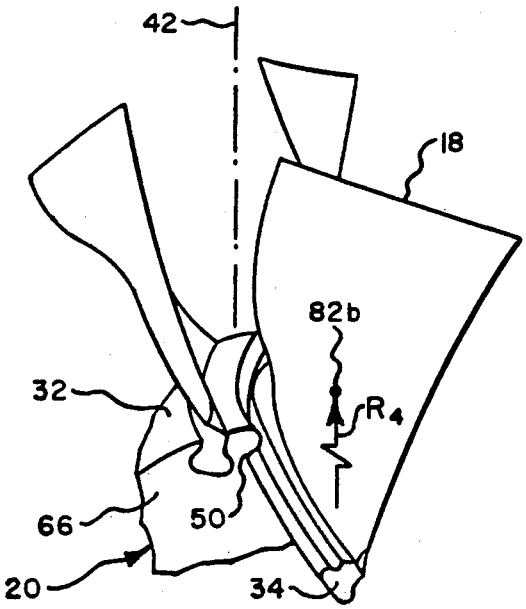
FIG. 7 is a perspective front view of the section of a bladed disk in accordance with the preferred embodiment of the present invention.
Figure 8:
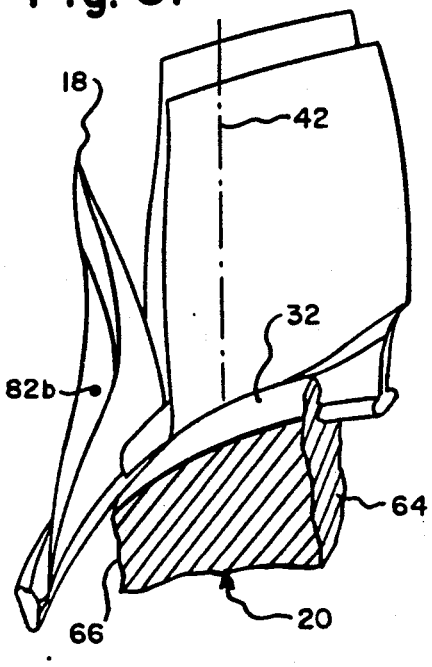
FIG. 8 is a side view of the bladed disk illustrated in FIG. 7.
Figure 9:
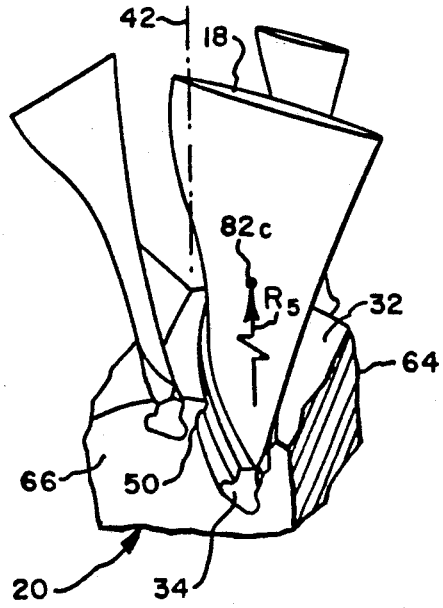
FIG. 9 is a perspective, front view of the bladed disk illustrated in FIG. 7 showing a blade in an intermediate position.
Figure 10:
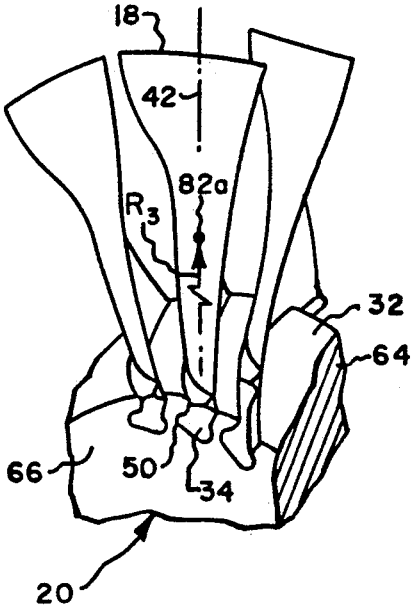
FIG. 10 is a perspective, front view of the bladed disk illustrated in FIG. 7 showing a blade in an installed position.

To better illustrate this particular feature according to a preferred embodiment of the present invention, reference is now made to FIGS. 1, 3 and 7–10. Beginning with FIG. 7, one of the blades 18 is shown upon partial insertion of the blade 18 into the slot 50 at the disk forward surface 66. Each of the blades 18 includes a center of gravity (C.G.) 82. FIG. 10 illustrates the blade 18 in an installed position with the dovetail 34 flush with both the disk forward surface 66 and the disk aft surface 64 and serves as a reference position. The C.G. 82*a* is disposed at an installed radial position $R_3$ measured from the disk axial centerline axis 16. The position of the center of gravity 82*a* in the installed position of the blade 18 is also illustrated in FIG. 1. When the blade 18 is partially inserted in the disk 20 from the forward surface 66 as shown in FIG. 7, the blade 18 is disposed relatively clockwise with respect to the blade 18 in the installed position illustrated in FIG. 10. This is because of the curved and twisted dovetail 34. In this partially inserted position of the blade 18, the C.G. 82 is disposed at a first radial position designated C.G. 82*b* at a radius $R_4$ as measured from the disk axial centerline axis 16, and also as shown in FIG. 1. FIG. 8 shows a side view of the blade 18 in the partially inserted position, and shows more clearly how the blade 18 is oriented substantially clockwise, in a tilted fashion relative to the blade 18 in the installed position illustrated in FIG. 10. FIG. 8 also illustrates clearly how the C.G. 82*b* is disposed well off to the right side of the rotor radial axis 42.

FIG. 9 illustrates the blade 18 at an intermediate position between the positions illustrated in FIGS. 7 and 10 showing the C.G. 82*c* at a radius $R_5$ relative to the disk axial centerline axis 16, which is also illustrated in FIG. 1. Note that the lean of the blade 18 in the clockwise direction is less in FIG. 9 than it is in FIG. 7 since the dovetail 34 is basically being screwed into the slot 50 in a counterclockwise direction.

Illustrated in FIG. 3 is the blade 15 in another position wherein it is partially inserted into the slot 50 relative the to the disk aft surface 64, or in other words the position is one showing the blade 18 being partially removed from the slot 50 from the disk aft surface 64. The blade 18 has a C.G. 82*d* at a second radial position $R_6$ relative to the disk axial centerline axis 16. Note that the blade 18 in FIG. 3 relative to the blade 18 in the installed position in FIG. 10 is rotated counterclockwise thereto due to the dovetail 34 being screwed counterclockwise into the dovetail slot 50. The C.G. 82*d* is now disposed to the left side of the radial axis 42 since the blade 18 is now leaning counterclockwise relative to the installed position of the blade 18 in FIG. 10 and relative to the radial axis 42. The position of the C.G. 82*d* is also shown in FIG. 1.

By this construction, the C.G.s 82 form a path 84 as illustrated in dash line in FIG. 1 which shows the relative position of the CGs 82 upon insertion of the blade 18 into the dovetail slot 50 to the installed position of the blade 18 as illustrated in FIG. 10 and then through to a removed, or partially inserted, position of the blade 18 relative to the aft surface 64 of the disk as illustrated in FIG. 3. It will be appreciated that the blade 18 due to the curved and twisted dovetail 34 must be screwed into the dovetail 50 which rotates the blade 18 in a counterclockwise direction thusly locating the C.G.s 82 from relative minimum positions (82*b* and 82*d*) relative to the disk axial centerline axis 16 to a maximum position at C.G. 82*a*. The helix radius r and the orientation of the helix axis 80 is selected depending upon the particular geometry of the bladed disk 12 to provide the preferred C.G. path 84 as illustrated in FIG. 1.

The C.G. 82*a* in the installed position of the blade 18 may thus be positioned exactly at a maximum radius $R_3$ as illustrated in FIG. 1. With the C.G. 82*a* so positioned, the blade 18 will have no component of the centrifugal force $F_c$ acting in an axial direction which would tend to slide the dovetail 34 out of the slot 50. This is because in order for the dovetail to slide from its installed position as illustrated in FIG. 10, the C.G. 82 must necessarily decrease in radial height from the maximum illustrated at C.G. 82*a*, which would be countered by the centrifugal force acting through the C.G. 82*a*. As the C.G. 82*a* tends to be positioned at a lower radius than the maximum radius $R_3$, the centrifugal force $F_c$ will tend to return the blade 18 in an upright position with the C.G. 82*a* disposed at the maximum radius $R_3$. Accordingly, the blade 18 in accordance with this preferred embodiment of the invention, is self retaining in the dovetail slot 50.

Of course, particular designs may result in a maximum radial position $R_3$ of the C.G. 82*a* located not in the installed positioned of the blade 18 as illustrated in FIG. 10 but to either side of such position. However, the axial component of centrifugal force associated with such position will be relatively low and may be accommodated by conventional axial blade retainers.

Referring again to FIG. 4, the relative positions of the disk axial centerline axis 16, the helix axis 80 and the dovetail longitudinal axis 62 are shown. As illustrated for this preferred embodiment of the invention, the helical axis 80 is disposed obliquely to the disk centerline axis 16 as described above for locating the dovetail 34 close to the outer perimeter 32 of the disk 20. FIG. 4 also illustrates that the root meanline $M_1$ is disposed generally parallel to the dovetail helical longitudinal axis 62. The blade 18 further includes a chord $C_3$ extending from the leading edge 28 to the trailing edge 30 at the blade tip 24 and the blade airfoil 22 is relatively highly twisted with the tip cord $C_3$ being disposed at an acute angle from the root chord $C_1$. FIG. 4 in conjunction with FIGS. 2 and 3 also illustrates a preferred orientation of the leading edge 28 aligned generally radially outwardly of the dovetail forward profile 58 for providing a direct radial path for centrifugal loads to the dovetail 34 for minimizing bending of the blade 18. The trailing edge 30 is similarly and preferably aligned generally radially outwardly of the dovetail aft profile 60 for providing a direct radial path for centrifugal forces from the blade 18 to the dovetail 34 for minimizing bending of the blade 18.

In the preferred and exemplary embodiment of the present invention, the dovetail longitudinal axis 62 is a section of the helix having a pitch of about 0.03 threads per inch, a helix radius r of about 5.0 inches, and a helix angle $\theta$ of about 45 degrees. Of course, the particular dimensions of the helix, the orientation of the dovetail 34 and the rotor disk 20 and relative twist of the dovetail profiles including the forward and aft profiles 58 and 60 are to be determined depending upon particular design applications in accordance with the invention.

The present invention provides an improved blade and rotor disk assembly utilizing a blade which allows for relatively low inlet radius ratios and relatively high slope of the inner flowpath of the blade as defined at the disk outer perimeter 32. For example, analysis and model tests indicate that inlet root radius ratios $R_1/R_2$ of less than about 0.35 and down to about 0.3 may be utilized for the blade 18 while still having acceptable HCF and LCF life limits. A generally shankless dovetail 34 as above described may be positioned relatively close and generally parallel to the sloping outer perimeter 32 of the disk 20 to provide adequate blade retention while reducing blade weight and maintaining adequate blade structural rigidity for maintaining adequate 2/REV margin. The dovetail 34 is preferably arcuate and twisted to allow adequate load accommodation in the complementary dovetail slot at both the aft surface 64 of the disk 20 and the forward surface 66 of the disk 20 which has a relatively small circumference.

The blades 18 may be inserted into the complementary dovetail slots 50 by twisting the blades into the slots from either the disk aft surface 64 or forward surface 66. Twisting from the aft surface 64 generally provides more clearance between adjacent blades since the circumference of the outer perimeter 32 at the disk aft surface 64 is larger than the circumference of the outer perimeter 32 at the disk forward surface 66. The use of a helical dovetail 34 and dovetail longitudinal axis 62 as described above allows for axial self retention of the blade 18 in the dovetail slots 50, or in the alternative, results in relatively low axial components of centrifugal load which would tend to slide the dovetails 34 from the slots 50.

While there have been described herein what are considered to be preferred embodiments of the present invention, other modifications of the invention shall be apparent to those skilled in art from the teachings herein, and it is therefore, desired to be secured in the appended claims all such modifications as fall within the true spirit and scope of the invention. More specifically, and for example, although a generally symmetrical, two-lobed dovetail 34 has been disclosed for the preferred embodiment, the dovetail 34 may have any profile including fir tree type profiles depending upon particular applications. Although many preferred features of the invention have been disclosed, such features may be used either singly or in combination.

Accordingly, what is desired to be secured by Letters Patent of the United States is the invention as defined and differentiated in the following claims:

1. A gas turbine engine rotor blade comprising:

an airfoil having a tip and a root, and a leading edge and a trailing edge extending from said root to said tip;

a dovetail extending from said airfoil root, said dovetail having:

a forward profile disposed adjacent to said airfoil leading edge;

an aft profile generally similar to said forward profile disposed adjacent to said airfoil trailing edge;

a longitudinal axis extending from said forward profile to said aft profile;

a radial axis extending perpendicularly from said longitudinal axis radially outwardly into said airfoil in a plane of said aft profile; and said forward profile being disposed at an angular position rotated about said dovetail longitudinal axis relative to said dovetail radial axis and said aft profile.

2. A blade according to claim 1 wherein said dovetail longitudinal axis comprises a section of a helix.

3. A blade according to claim 1 wherein said airfoil root has a meanline extending from leading edge to said trailing edge and said dovetail longitudinal axis is disposed generally parallel thereto.

4. A blade according to claim 1 wherein said dovetail comprises:

a shank; and a pair of lobes extending radially inwardly from said shank and oppositely outwardly from said dovetail radial axis.

5. A blade according to claim 4 wherein each of said lobes includes a peak, and said lobe pair includes a chord extending between said lobe peaks, said chord in said dovetail aft profile being an aft chord and said chord in said dovetail forward profile being a forward chord, said forward chord being rotated relative to said aft chord.

6. A blade according to claim 5 wherein said forward chord is rotated about 60 degrees from said aft chord.

7. A blade according to claim 6 wherein said dovetail longitudinal axis comprises a section of a helix.

8. A blade according to claim 7 wherein said helix has a pitch of about 0.03 threads per inch, a helix radius of about 5.0 inches and a helix angle of about 45 degrees.

9. A blade according to claim 4 wherein said dovetail longitudinal axis has a slope relative to said dovetail radial axis in a plane extending between said forward and aft profiles.

10. A blade according to claim 9 wherein said dovetail aft profile is disposed radially closer to said airfoil than said dovetail forward profile is and said dovetail aft profile is symmetrical about said radial axis.

11. A blade according to claim 10 wherein said airfoil trailing edge is aligned generally radially outwardly of said dovetail aft profile and said airfoil leading edge is aligned generally radially outwardly of said dovetail forward profile.

12. A blade according to claim 11 wherein said airfoil tip has a tip chord and said airfoil root has a root chord, and said airfoil is twisted so that said tip chord is disposed at an acute angle relative to said root chord, and said dovetail longitudinal axis slope is in a range of about 55–70 degrees.

13. A blade according to claim 4 wherein all profiles of said dovetail between said forward and aft profiles are perpendicular to said dovetail longitudinal axis, including said forward and aft profiles, and are identical.

14. A blade according to claim 13 wherein said dovetail longitudinal axis comprises a section of a helix and each of said dovetail profiles is rotated relative to adjacent ones of said profiles.

15. A blade according to claim 4 wherein said shank has a radial thickness and said lobe pair has a radial thickness and said dovetail is substantially shankless with said shank thickness being no greater than about said thickness of said lobe pair.

16. A blade according to claim 1 wherein each profile of said dovetail disposed between said forward and aft profiles is perpendicular to said dovetail longitudinal axis and is symmetrical.

17. A bladed disk assembly for a gas turbine engine having a plurality of rotor blades according to claim 1, and further comprising:

a rotor disk including a forward surface, an aft surface, an outer perimeter joining said forward and aft surfaces, an axial centerline axis, and a plurality of circumferentially spaced slots disposed in said outer perimeter extending from said forward surface to said aft surface, said slots being complementarily shaped to said blade dovetails, and said blade dovetails of said plurality of rotor blades being disposed in respective ones of said disk slots.

18. A bladed disk assembly according to claim 17 wherein said dovetail longitudinal axis comprises a section of a helix.

19. A bladed disk assembly according to claim 18 wherein said helix includes a longitudinal centerline helix axis disposed obliquely to said disk axial centerline axis.

20. A bladed disk assembly according to claim 17 wherein said airfoil root has a meanline extending from said leading edge to said trailing edge and said dovetail longitudinal axis is disposed generally parallel thereto.

21. A bladed disk assembly according to claim 17 wherein said dovetail comprises:

a shank; and a pair of lobes extending radially inwardly from said shank and oppositely outwardly from said dovetail radial axis.

22. A bladed disk assembly according to claim 21 wherein each of said lobes includes a peak, and said lobe pair includes a chord extending between said lobe peaks, said chord in said dovetail aft profile being an aft chord and said chord in said dovetail forward profile being a forward chord, said forward chord being rotated relative to said aft chord.

23. A bladed disk assembly according to claim 22 wherein said dovetail forward profile is adjacent to said disk forward surface and said dovetail aft profile is adjacent to said disk aft surface; and adjacent ones of said dovetail forward profiles are disposed closer to each other than adjacent ones of said dovetail aft profiles are disposed to each other.

24. A bladed disk assembly according to claim 23 wherein said forward chord is rotated about 60 degrees from said aft chord.

25. A bladed disk assembly according to claim 24 wherein said helix has a pitch of about 0.03 threads per inch, a helix radius of about 5.0 inches, and a helix angle of about 45 degrees.

26. A bladed disk assembly according to claim 17 wherein said dovetail longitudinal axis has a slope relative to said disk axial centerline axis.

27. A bladed disk assembly according to claim 26 wherein said disk outer perimeter has a slope from said forward surface to said aft surface relative to said disk axial centerline axis.

28. A bladed disk assembly according to claim 27 wherein said disk outer perimeter slope is generally equal to said dovetail longitudinal axis slope.

29. A bladed disk assembly according to claim 28 wherein said dovetail comprises:

a shank having a radial thickness; and a pair of lobes extending radially inwardly from said shank and oppositely outwardly from said dovetail radial axis, and said lobe pair having a radial thickness; and said dovetail is substantially shankless with said shank thickness being no greater than about said thickness of said lobe pair.

30. A bladed disk assembly according to claim 29 wherein said airfoil trailing edge is aligned generally radially outwardly of said dovetail aft profile and said airfoil leading edge is aligned generally radially outwardly of said dovetail forward profile.

31. A bladed disk assembly according to claim 30 wherein said airfoil tip has a tip chord and said airfoil root has a root chord, and said airfoil is twisted so that said tip chord is disposed at an acute angle relative to said root chord, and said dovetail longitudinal axis slope is in a range of about 20 to about 35 degrees.

32. A bladed disk assembly according to claim 17 wherein all profiles of said dovetail between said forward and aft profiles are perpendicular to said dovetail longitudinal axis, including said forward and aft profiles, and are identical.

33. A bladed disk assembly according to claim 32 wherein said dovetail longitudinal axis comprises a section from a helix and each of said dovetail profiles is rotated relative to adjacent ones of said profiles.

34. A bladed disk assembly according to claim 17 wherein each profile of said dovetail disposed between said forward and aft profiles is perpendicular to said dovetail longitudinal axis and is symmetrical.

35. A bladed disk assembly according to claim 17 wherein said rotor blades have an inlet root radius ratio at said leading edges thereof, and an outlet root radius ratio at said trailing edges thereof which is larger than said inlet root radius ratio.

36. A bladed disk assembly according to claim 35 wherein said inlet root radius ratio is less than about 0.35 and down to about 0.3.

37. A bladed disk assembly according to claim 17 wherein said dovetail longitudinal axis comprises a section of a helix, each of said rotor blades includes a center of gravity, and said blade dovetail is positioned in said disk so that said center of gravity of said blade is at an installed radial position greater than a first radial position of said center of gravity upon partial insertion of said blade into said slot.

38. A bladed disk assembly according to claim 37 wherein said first radial position occurs upon partial insertion of said blade into said slot at said disk forward surface.

39. A bladed disk assembly according to claim 38 wherein said center of gravity of said blade at said installed radial portion is greater than a second radial position of said center of gravity upon partial insertion of said blade into said slot at said aft surface.

40. A bladed disk assembly according to claim 39 wherein said center of gravity of said blade at said installed position is a maximum.

* * * * *